US006279839B1

(12) United States Patent
Chang

(10) Patent No.: US 6,279,839 B1
(45) Date of Patent: Aug. 28, 2001

(54) PISTOL NOZZLE

(76) Inventor: Jung-Hsien Chang, 7F-2, No. 5, Fu An St., Fu An Li, Shi-Tun Chu, Taichung (TW)

( * ) Notice: Subject to any disclaimer, the term of this patent is extended or adjusted under 35 U.S.C. 154(b) by 0 days.

(21) Appl. No.: 09/571,880

(22) Filed: May 15, 2000

(51) Int. Cl.[7] ..... B05B 7/02; B05B 9/01; A62C 31/02

(52) U.S. Cl. ..... 239/525; 239/391; 239/526

(58) Field of Search ..... 239/525, 526, 239/583, 391, 392, 394, 396, 436, 443, 444, 446, 460, 440, 441, 449

(56) References Cited

U.S. PATENT DOCUMENTS

| | | | | |
|---|---|---|---|---|
| 4,448,355 | * | 5/1984 | Roman | 239/526 |
| 4,666,085 | * | 5/1987 | Liaw | 239/394 |
| 5,232,162 | * | 8/1993 | Chih | 239/394 |
| 5,323,968 | * | 6/1994 | Kingston et al. | 239/449 |
| 5,333,792 | * | 8/1994 | Wang | 239/440 |
| 5,348,228 | * | 9/1994 | Wang | 239/394 |
| 5,630,548 | * | 5/1997 | Chih | 239/394 |
| 5,732,886 | * | 3/1998 | Liaw | 239/526 |
| 5,740,968 | * | 4/1998 | Mueller | 239/526 |

FOREIGN PATENT DOCUMENTS

| | | | | |
|---|---|---|---|---|
| 2827402 | * | 1/1980 | (DE) | 239/526 |

* cited by examiner

*Primary Examiner*—David A. Scherbel
*Assistant Examiner*—Davis Hwu
(74) *Attorney, Agent, or Firm*—Bacon & Thomas, PLLC

(57) ABSTRACT

A pistol nozzle comprises a main body, an action rod, a locating seat, a hand lever, and an adjustment sleeve. The main body has a handle which is provided with a flow hole in communication with a through hole of the main body. The action rod is movably disposed in the through hole and is provided with an arcuate slot and a spring fitted thereover. The locating seat is provided with a locating portion which is disposed in the slide slot of the locating seat for locating the action rod. The action rod is confined by the arcuate slot which is engaged with the protruded edge of the slide slot of the locating seat. The locating seat is provided with a threaded rod which is engaged with a threaded hole of the adjustment sleeve via a hole of the hand lever. As the hand lever is exerted on by an external force, the action rod displaces to bring about the discharge of water by the pistol nozzle.

3 Claims, 8 Drawing Sheets

Fig • 2

PRIOR ART

Fig • 3

PRIOR ART

Fig • 4

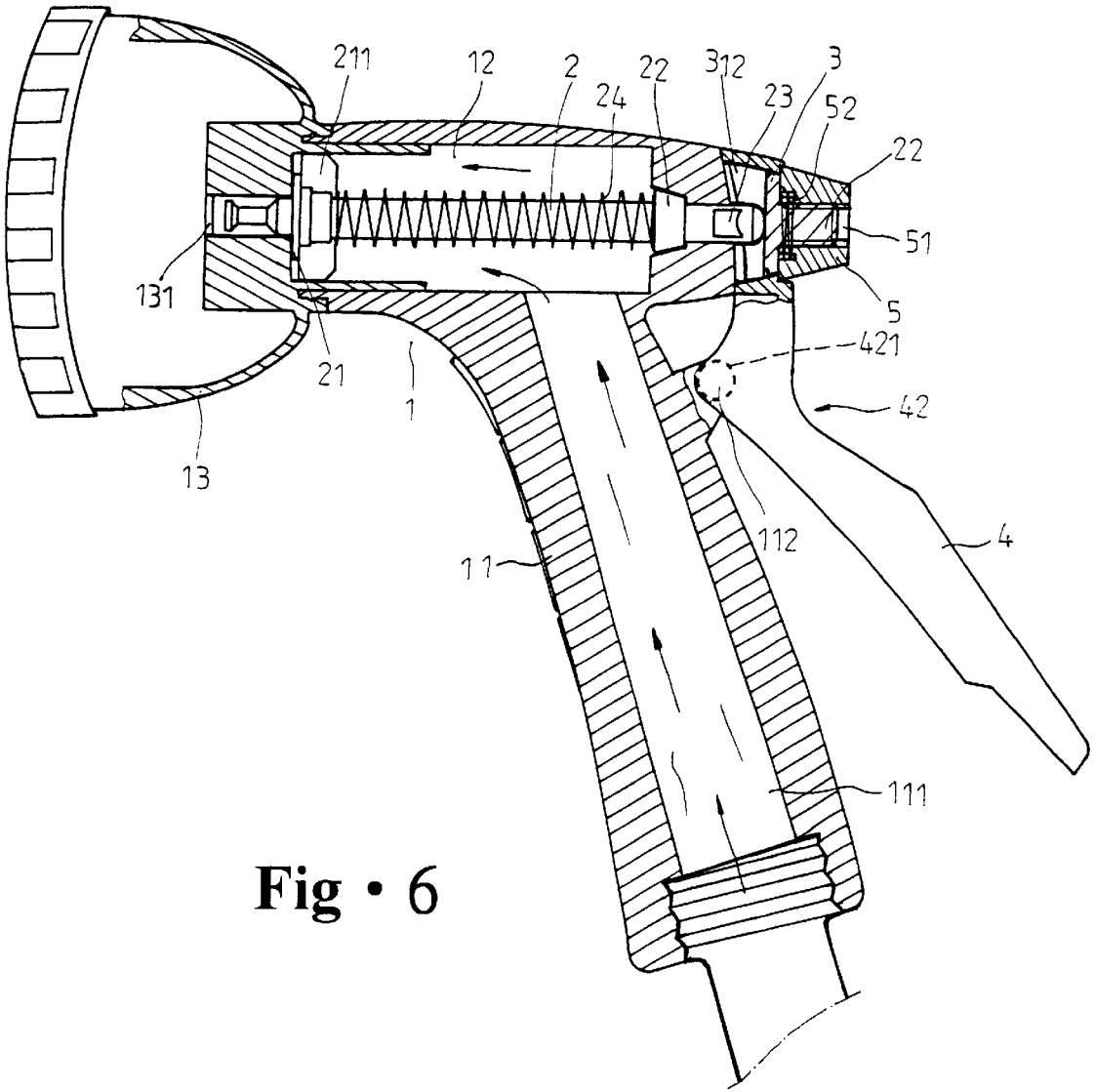
Fig • 6

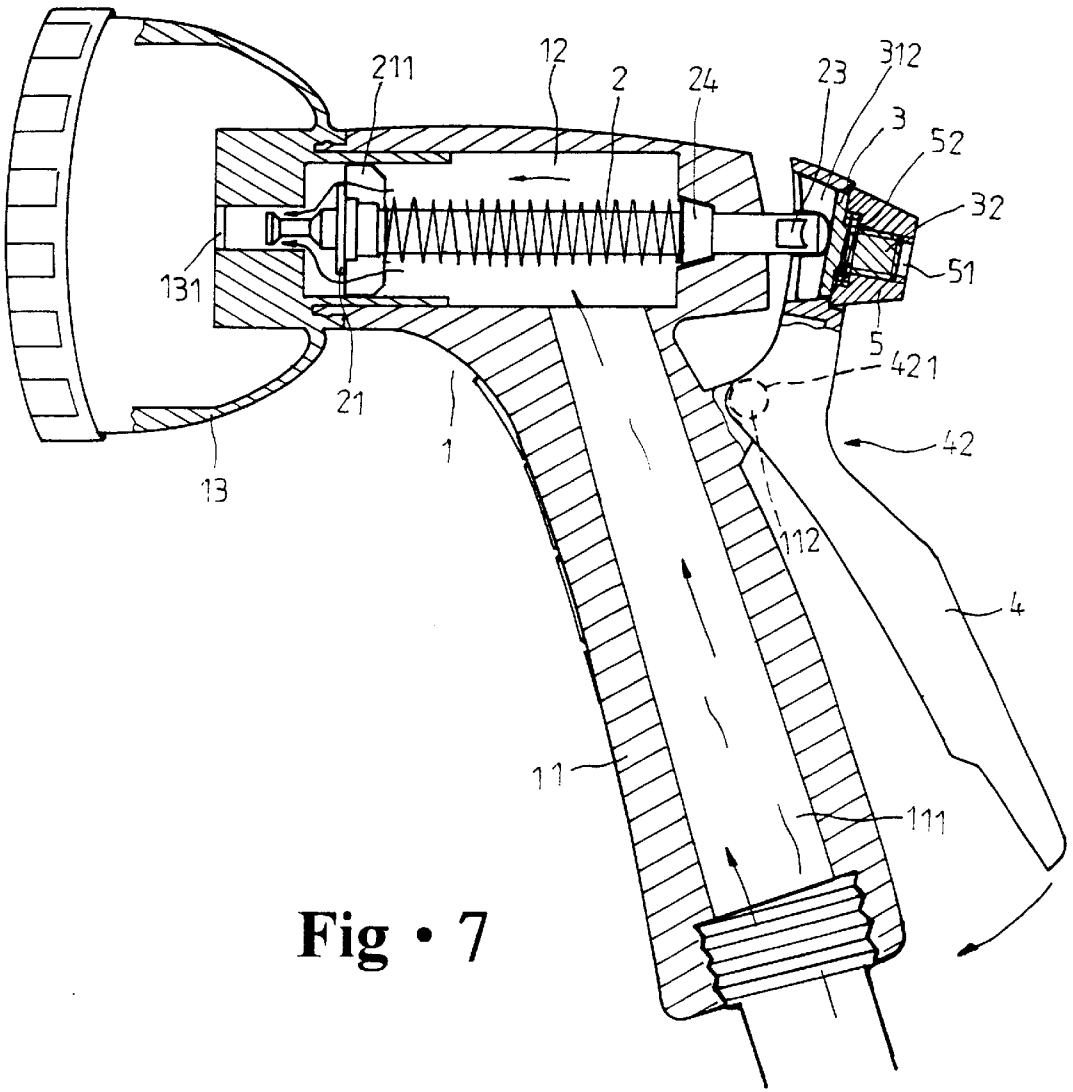
Fig • 7

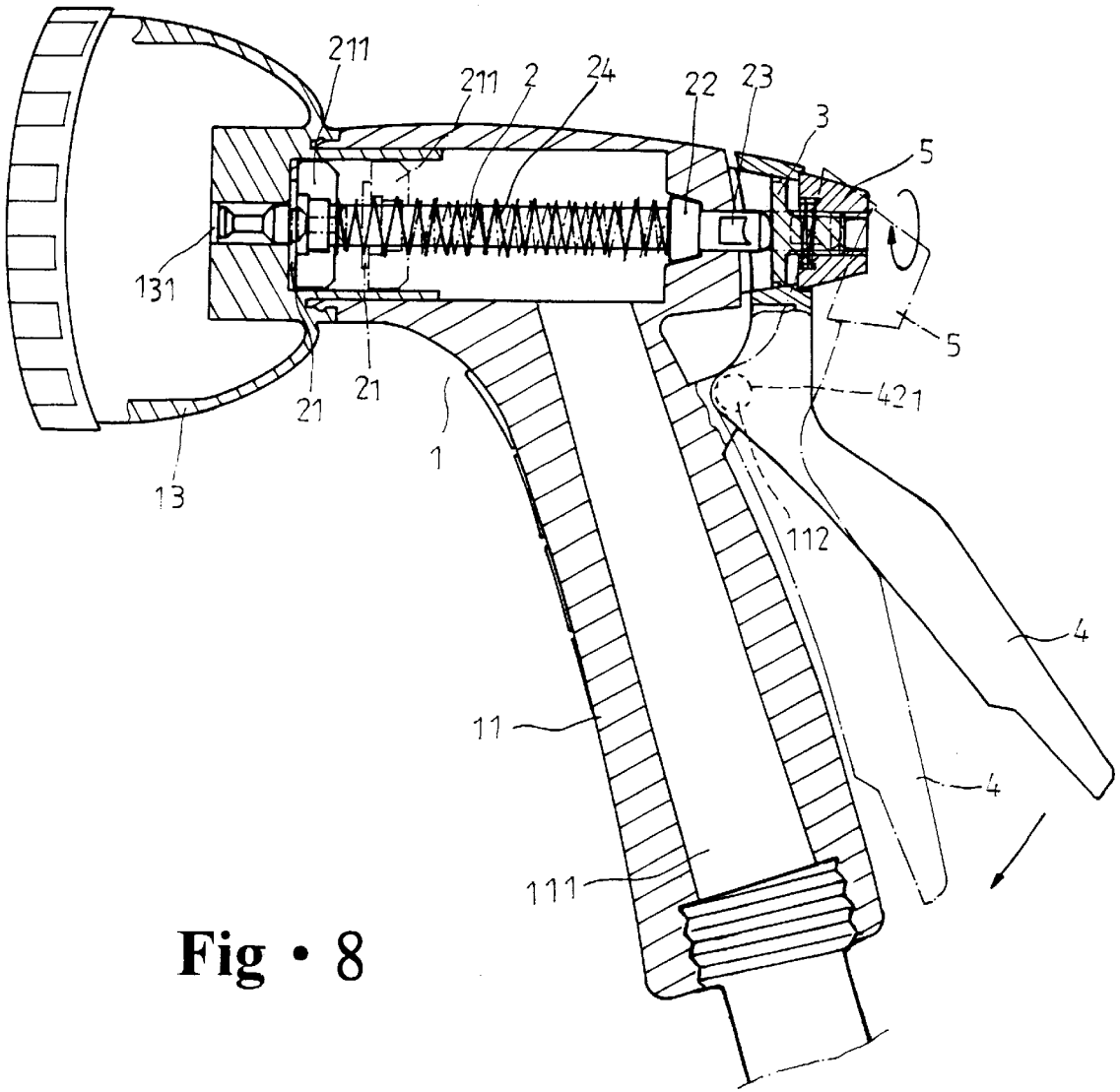
Fig • 8

PISTOL NOZZLE

FIELD OF THE INVENTION

The present invention relates generally to a sprinkling device, and more particularly to a nozzle.

BACKGROUND OF THE INVENTION

As shown in FIGS. 1 and 2, a pistol nozzle of the prior art comprises a main body 10, an action rod 20, a hand lever 30, and an adjustment nut 40. The main body 10 is provided with a through hole 101 and a head 102 which is in turn provided with a outlet 103 in communication with the through hole 101. The main body 10 is further provided a handle 104 thereof with a flow hole 105 in communication with the through hole 101. The action rod 20 is disposed in the through hole 101 and is provided at the front end thereof with an annular body 202 having a water-distributing rib 202. The annular body 202 acts to a water-distributing rib 201. The annular body 202 acts to obstruct the outlet 103 of the head 102. The action rod 20 is provided in the proximity of one end thereof with an obstruction portion 203 for confining a spring 204 in conjunction with the annular body 202. The action rod 20 is further provided at one end thereof with a threaded portion 205, which is engaged with the adjustment nut 40 via the slide hole 301 of the top end of the hand lever 30. The hand lever 30 has a curved portion 302, which is pivoted with the handle 104 of the main body 10. The main body 10 is provided at the rear end thereof with a fastening ring 106 for fastening the top end of the hand lever 30 at an appropriate distance.

As shown in FIG. 3, when the hand lever 30 is pressed, the hand lever 30 swivels on the pivoting point at which the hand lever 30 is pivoted with the handle 104. As a result, the top end of the handle 104 is pulled rearwards. In the meantime, the rear end of the action rod 20 is caused to slide along the slide hole 301 of the hand lever 30. In light of the action rod 20 being engaged with the adjustment nut 40, the action rod 20 moves rearwards at the time when the top end of the handle 104 is pulled rearwards, thereby causing the annular body 202 of the front end of the action rod 20 to move away from the outlet 103 so as to allow the passage of water through the flow hole 105, the through hole 101, and the water-distributing rib 201 of the annular body 202. The water is finally emitted through the outlet 103. The spring 204, which is fitted over the action rod 20, is compressed by the displaced annular body 202 and the obstruction portion 203. As the hand lever 30 is relieved of the pressure exerting thereon, the recovery force of the compressed spring 204 forces the action rod 20 and the hand lever 30 to move back to their original positions.

Such a pistol nozzle of the prior art as described above is defective in design in that the slide hole and the adjustment bolt are so exposed as to be vulnerable to impact or damage, thereby disabling the pistol nozzle. In addition, the exposed adjustment bolt undermines the overall esthetic effect of the prior art pistol nozzle. Moreover, when the action rod is pulled rearwards, the adjustment nut is unable to be actuated by the slide hole with certainly, thereby causing the action rod to sway or move aside. As a result, the action rod is not fully acted on by the force exerting on the hand lever. The user of the prior art pistol nozzle is thus apt to tire out.

SUMMARY OF THE INVENTION

The primary objective of the present invention is to provide a pistol nozzle which is free from the drawbacks of the prior art pistol nozzle described above.

In keeping with the principle of the present invention, the foregoing objective of the present invention is attained by the pistol nozzle comprising a main body in which an action rod is disposed such that the action rod is slidably fastened at one end thereof with a hand lever to slide in the locating seat slide slot. The amount of water being emitted via the outlet is adjusted by the water flow between the through hole and the action rod. An adjustment sleeve is fastened with one end of the action rod, with the one end of the action rod being fastened with the locating seat. The action rod, the locating seat and other component parts are all concealed in the main body in such a way that they do not undermine the overall esthetic effect of the pistol nozzle of the present invention.

The locating seat of the present invention is provided with two slide slots, each having a protruded edge engageable with the arcuate slot of the action rod. In light of the locating portion of the slide slot being located in the middle of the slide slot and narrower than both ends of the slide slot, the arcuate slot of the action rod is located by the locating portion of the slide slot at the time when the action rod moves rearwards along with the locating seat. The rearward displacement of the action rod can be thus carried out without causing the action rod sway or move aside. In other words, the action rod is fully acted on by an external force exerting on the hand lever of the pistol nozzle of the present invention.

The features and the advantages of the present invention will be more readily understood upon a thoughtful deliberation of the following detailed description of a preferred embodiment of the present invention with reference to the accompanying drawings.

BRIEF DESCRIPTION OF THE DRAWINGS

FIGS. 6–8 are schematic views of the preferred embodiment of the invention in action

DETAILED DESCRIPTION OF THE PREFERRED EMBODIMENT

Figure 1:
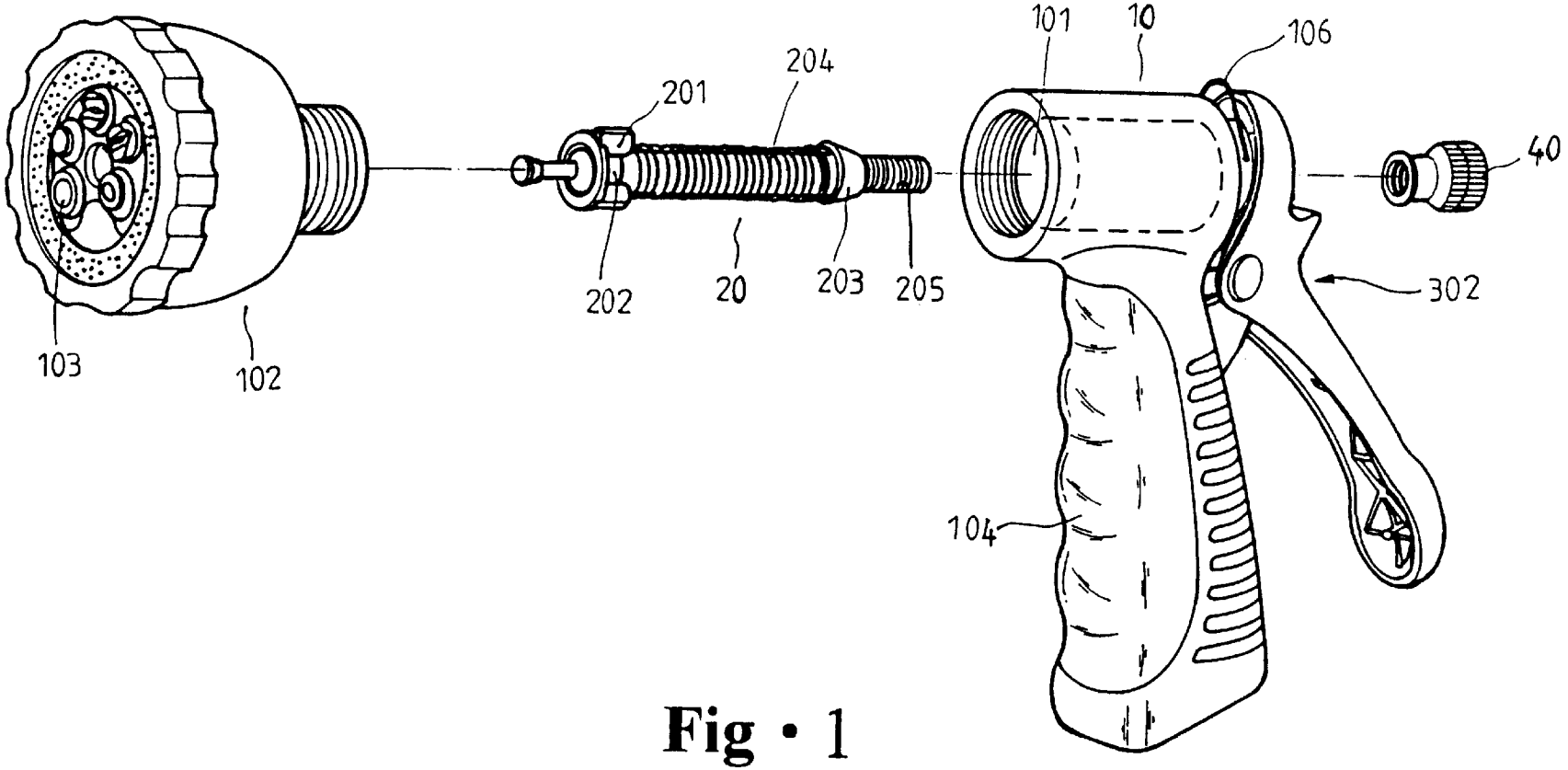
Fig. 1 PRIOR ART
FIG. 1 shows an exploded view of a pistol nozzle of the prior art.
Figure 2:
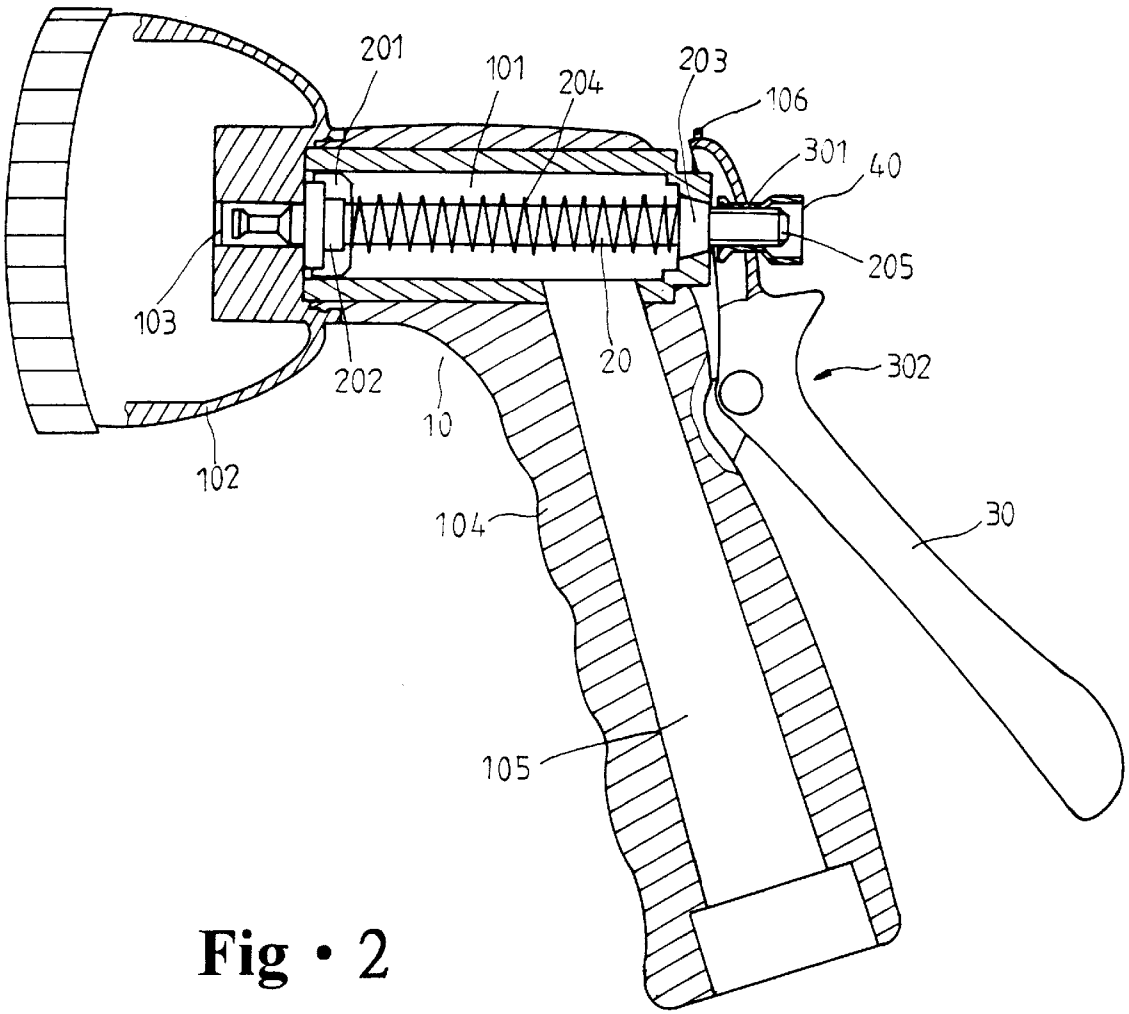
FIG. 2 shows a sectional schematic view of the pistol nozzle of the prior art in combination.
Figure 3:
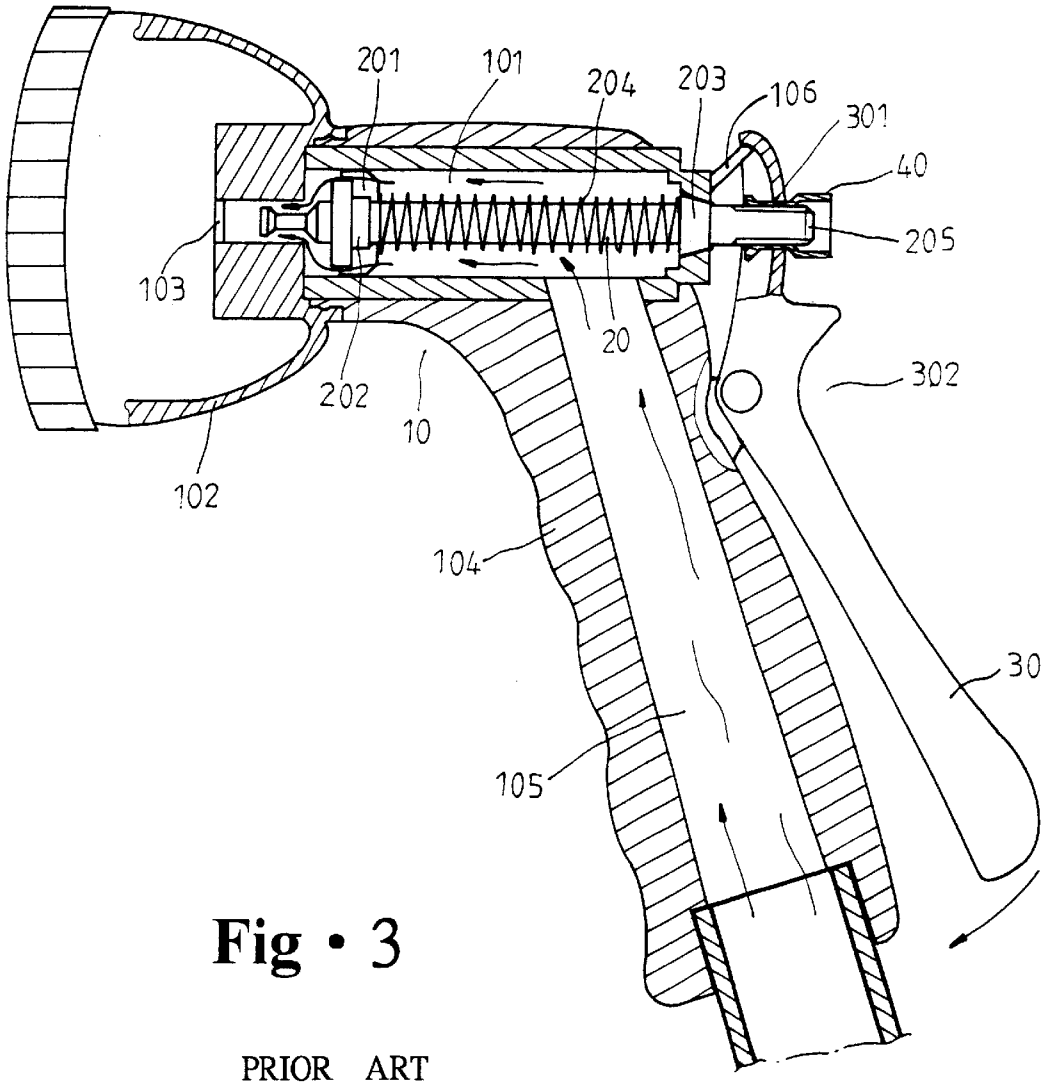
FIG. 3 shows a schematic view of the pistol nozzle of the prior art in action.

As shown in FIGS. 4–8, a pistol nozzle embodied in the present invention comprises a main body 1, an action rod 2, a locating seat 3, a hand lever 4, and an adjustment sleeve 5.

The main body 1 has a handle 11 and is provided therein with a through hole 12 in communication with a flow hole 111 of the handle 11. The handle 11 is provided with a pivot 112. The main body 1 is provided at the front end with a head 13 fastened therewith. The head 13 is provided in the interior thereof with an outlet 131 in communication with the through hole 12, thereby enabling the flow hole 111, the through hole 12 and the outlet 131 to be in communication with one another.

The action rod 2 is disposed in the through hole 12 of the main body 1 and is provided at the front end thereof with an annular body 21 fastened therewith. The annular body 21 is provided with a water-distributing hole 211. The action rod 2 is provided in the proximity of one end thereof a stop portion 22 and an arcuate slot 23 located behind the stop portion 22. The action rod 2 is further provided with a spring 24 fitted thereover such that the spring 24 is disposed between the annular body 21 and the stop portion 22.

The locating seat 3 is provided with a slide slot 31 with an open end 311. The slide slot 31 is provided in two sides thereof with a protruded edge 312 and is further provided at both ends thereof with an enlarged portion 313. The slide slot 31 is provided in the middle portion thereof with a locating portion 314. The locating seat 3 is provided at one end with a threaded rod 32.

The hand lever 4 is provided in the top end with a hole 41 which is curved such that a curved portion 42 thereof is provided with a pivoting hole 421.

The adjustment sleeve 5 is provided with a threaded hole 51, and a spring 52 fitted thereover.

Figure 4:
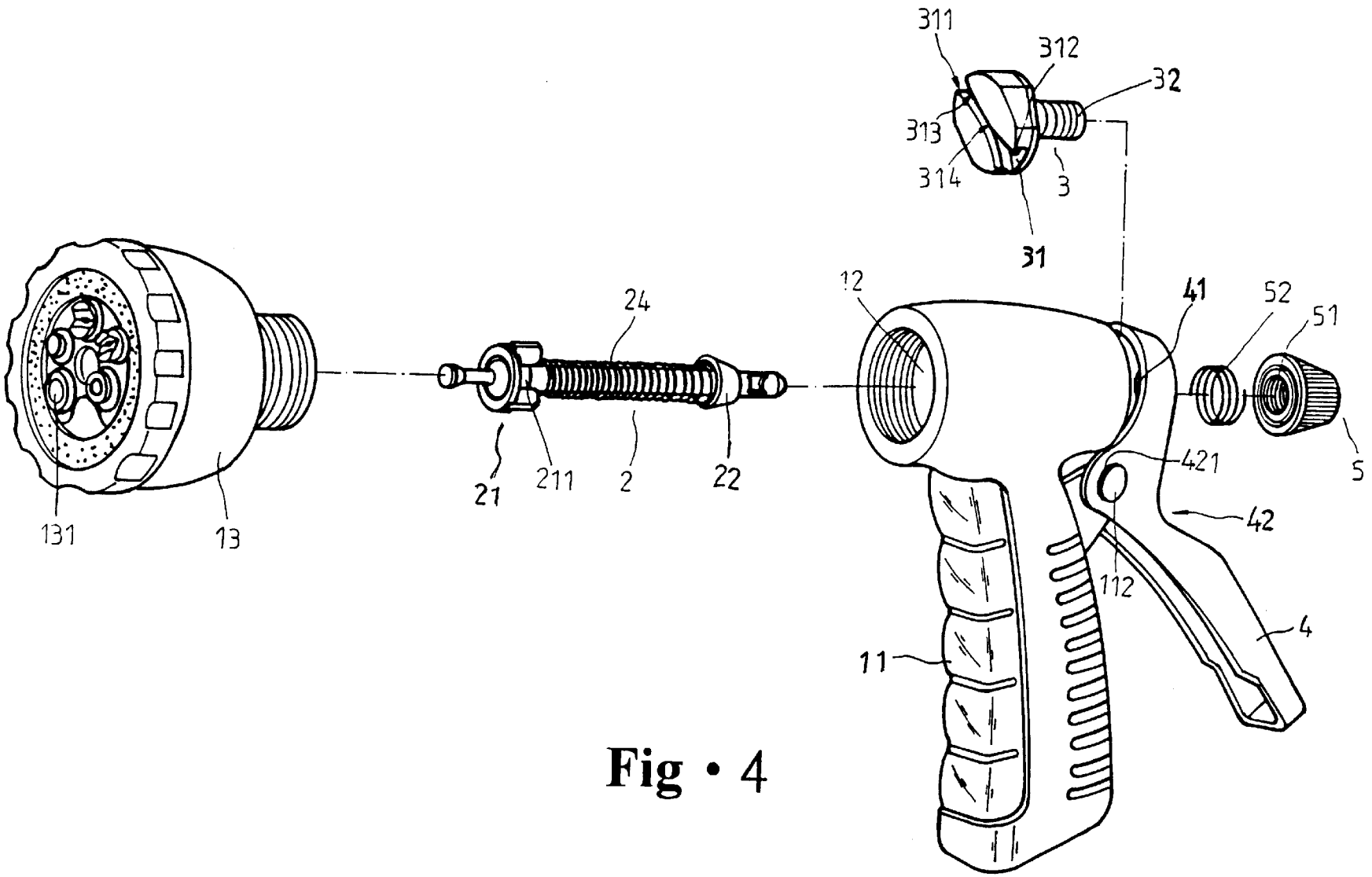
FIG. 4 shows an exploded view of the preferred embodiment of the present invention.
Figure 5:
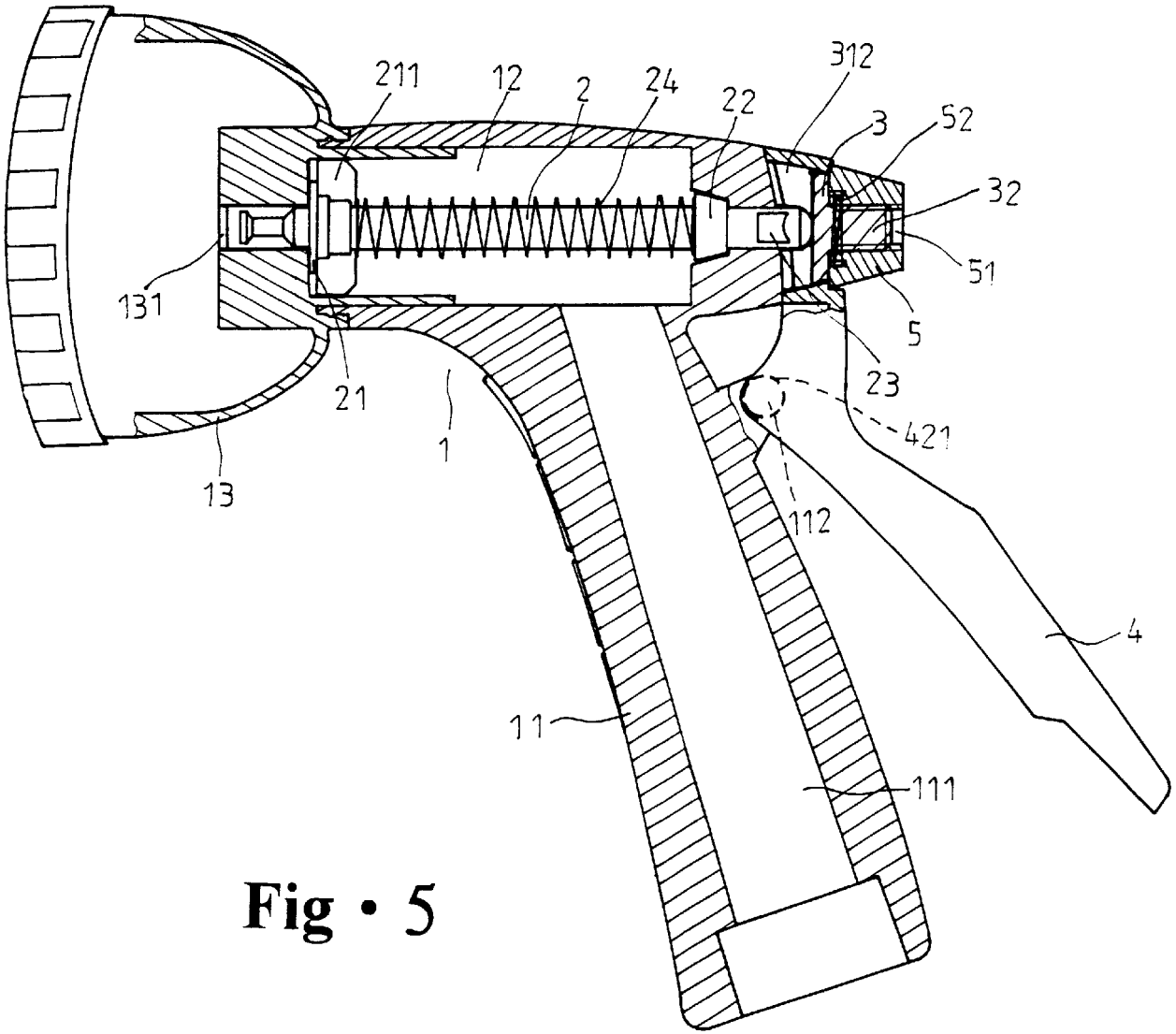
FIG. 5 shows a sectional schematic view of the preferred embodiment of the present invention in combination.

As illustrated in FIGS. 4 and 5, the action rod 2 is disposed in the through hole 12 of the main body 1 such that the head 13 is fastened with the front end of the main body 1, and that one end of the action rod 2 is confined by the protruded edges 312 of the slide slot 31, and that the action rod 2 is capable of sliding in the slide slot 31. As the arcuate slot 23 of the action rod 2 slides to the locating portion 314 of the slide slot 31, the arcuate slot 23 is located by the locating portion 314. The pivoting hole 421 of the hand lever 4 is pivoted with the pivot 112 of the handle 11 of the main body 1, thereby enabling the hand lever 4 to turn on the pivot. The threaded rod 32 of the locating seat 3 is engaged with the threaded hole 51 of the adjustment sleeve 5 via the hole 41 of the hand lever 4. The action rod 2, the locating seat 3, and the adjustment sleeve 5 are thus fastened together. The rear end opening of the through hole 12 of the main body 1 is stopped by the adjustment sleeve 5 to enable water to flow toward the head 13. The hand lever 4 is urged by the spring 52 which is fitted over the adjustment sleeve 5.

As shown in FIG. 6, a water hose 6 is connected with the flow hole 111 of the handle 11 such that the outlet 131 of the head 13 is obstructed by the annular body 21 of the action rod 2. As a result, when water in the hose 6 enters the flow hole 111 and then to the through hole 12, the water is not able to flow through the outlet 131 which is obstructed by the annular body 21 of the action rod 2.

As shown in FIG. 7, when the hand lever 4 is pressed with hand of a user of the pistol nozzle of the present invention, the hand lever 4 turns on the pivoting point on which the hand lever 4 is pivoted with the handle 11 of the main body 1. As a result, the top end of the hand lever 4 is pulled rearward, thereby resulting in the rearward movements of the locating seat 3 and the action rod 2. In the meantime, the arcuate slot 23 of the action rod 2 slides slightly in the slide slot 31 of the locating seat 3. As the action rod 2 moves rearwards, the annular body 21 of the front end of the action rod 2 moves away from the outlet 131 of the head 13, thereby allowing water to flow from the through hole 12 to the outlet 131 via the water-distributing hole 211 of the annular body 21 of the action rod 2. The water is thus emitted through the outlet 131. When the action rod 2 moves rearwards, the stop portion 22 of the action rod 2 is stopped by the through hole 12 such that the spring 24 is compressed by the stop portion 22 and the annular body 21. When the hand lever 4 is relieved of the external force exerting thereon, the recovery force of the compressed spring 24 forces the action rod 2, the locating seats 3, and the hand lever 4 to return to their original positions.

As shown in FIG. 8, when the distance between the adjustment sleeve 5 and the threaded rod 32 of the locating seat 3 is adjusted, the position of the locating seat 3 is adjusted. The extent to which the spring 24 is compressed is adjusted. As a result, the annular body 21 of the action rod 2 can be adjusted in position so as to adjust the flow of water between the action rod 2 and the through hole 12. When the distance referred to above is greater, the water flow is less at the time when the user exerts a greater pressure. When the distance is shorter, the water flow is greater by exerting a smaller pressure. The amount of water being discharge from the outlet 131 of the head 13 can be thus easily regulated.

The locating portion of the slide slot of the locating seat is narrower. When the action rod and the locating seat join together, the arcuate slot of the action rod is confined in the locating portion. When the hand lever is acted on by the force of a user, the action rod is actuated by the locating seat to move rearwards. In view of the action rod being confined by the locating portion of the slide slot, the action rod can be actuated to move rearwards with certainty by the hand lever and the locating seat, so as to prevent the action rod from swaying or moving aside. In other words, the action rod is fully acted on by the external force exerting on the hand lever. The position of the locating seat can be adjusted by adjusting the fastening length between the adjustment sleeve and the locating seat. The position of the annular body of the action rod is adjusted by the extent to which the spring of the action rod is compressed as well as the distance of the rearward movement of the action rod. As a result, the flow of water between the action rod and the through hole can be adjusted by the magnitude of the force exerting on the hand lever. The action rod, the locating seat, and other component parts are all concealed in the main body and the hand lever to improve the appearance of the pistol nozzle of the present invention.

What is claimed is:

1. A pistol nozzle comprising:

a main body having a handle which is provided with a flow hole, said main body provided with a through hole in communication with said flow hole of said handle, said main body provided at a front end thereof with a head fastened therewith and provided with an outlet;

an action rod movably disposed in said through hole of said main body and provided at a front end thereof with an annular body fastened therewith, said action rod provided at a rear end thereof with a stop portion and an arcuate slot, said action rod further provided with a spring fitted thereover such that said spring is disposed between said annular body and said stop portion;

a locating seat provided with a slide slot which has an open end and two protruded edges, said rear end of said action rod being disposed in said slide slot such that said action rod is confined by said protruded edges engaging said arcuate slot of said action rod, said slide slot provided at two ends thereof with an enlarged portion, and in a middle portion thereof with a locating portion narrower than said enlarged portion and capable of holding said arcuate slot of said action rod, said locating seat provided at a rear end with a threaded rod extending therefrom;

a hand lever provided at a top end thereof with a hole for receiving said threaded rod of said locating seat; and an adjustment sleeve provided with a threaded hole which is engaged with said threaded rod of said locating seat whereby said adjustment sleeve is rotated to cause said slide slot of said locating seat to engage said arcuate slot of said action rod.

2. The pistol nozzle as defined in claim 1, wherein said hole of said hand lever is curved such that a curved portion thereof is provided with a pivoting hole whereby said pivoting hole is engaged with a pivot of said handle of said main body.

3. The pistol nozzle as defined in claim 1, wherein said annular body of said action rod is provided with a plurality of water-distributing holes.

* * * * *